US006888299B2

(12) United States Patent
Hwang et al.

(10) Patent No.: US 6,888,299 B2
(45) Date of Patent: May 3, 2005

(54) ELECTRON GUN FOR CATHODE RAY TUBE HAVING SVM COIL AND CATHODE RAY TUBE USING THE ELECTRON GUN

(75) Inventors: Se Ja Chul Hwang, Suwon (KR); Duk-Sung Park, Suwon (KR); Yeong-Guon Won, Suwon (KR); Bong-Wook Jung, Seongnam (KR)

(73) Assignee: Samsung SDI Co., Ltd., Suwon (KR)

( * ) Notice: Subject to any disclaimer, the term of this patent is extended or adjusted under 35 U.S.C. 154(b) by 393 days.

(21) Appl. No.: 10/045,663

(22) Filed: Jan. 16, 2002

(65) Prior Publication Data

US 2002/0109452 A1 Aug. 15, 2002

(30) Foreign Application Priority Data

Jan. 17, 2001 (KR) ..... 2001-2727

(51) Int. Cl.[7] ..... H01J 29/51
(52) U.S. Cl. ..... 313/414; 313/412; 315/15
(58) Field of Search ..... 313/412, 413, 313/414, 421, 449, 451; 315/15

(56) References Cited

U.S. PATENT DOCUMENTS 4,686,420 A * 8/1987 Kamohara ..... 315/15
5,077,498 A * 12/1991 Odenthal ..... 315/15
6,617,777 B2 * 9/2003 Taguchi et al. ..... 313/412

FOREIGN PATENT DOCUMENTS

| | | | |
|---|---|---|---|
| JP | 55-146847 | 11/1980 | |
| JP | 8-115684 | 5/1996 | |
| JP | 11-162372 | 6/1999 | |
| JP | 2003031154 A * | 1/2003 | ..... H01J/29/48 |

* cited by examiner

*Primary Examiner*—Vip Patel
*Assistant Examiner*—Karabi Guharay
(74) *Attorney, Agent, or Firm*—Christie, Parker & Hale, LLP

(57) ABSTRACT

An electron gun for a cathode ray tube and a cathode ray tube using such electron gun is provided. The electron gun includes a cathode for emitting an electron beam; a plurality of grid electrodes aligned sequentially from the cathode, one of the grid electrodes including a plurality of focusing electrodes that are mounted with a predetermined gap therebetween; a support for fixing the grid electrodes in their aligned arrangement; and a shield electrode mounted covering the gap(s) of the focusing electrodes and extending a predetermined distance over the focusing electrodes. The cathode ray tube includes the electron gun; a neck, within which the electron gun is mounted; and a scanning velocity modulation coil mounted on an outer circumference of the neck corresponding to the positioning of the gap(s) of the focusing electrodes.

9 Claims, 5 Drawing Sheets

ELECTRON GUN FOR CATHODE RAY TUBE HAVING SVM COIL AND CATHODE RAY TUBE USING THE ELECTRON GUN

CROSS-REFERENCE TO RELATED APPLICATION

This application claims priority of Korea patent Application No. 2001-0002727, filed on Jan. 17, 2001.

BACKGROUND OF THE INVENTION (a) Field of the Invention

The present invention relates to a cathode ray tube, and more particularly, to an electron gun for a cathode ray tube having an scanning velocity modulation coil.

(b) Description of the Related Art

A cathode ray tube (CRT) typically includes a panel, a funnel, and a neck, which are integrally fused to define an exterior of the CRT. A phosphor screen is formed on an interior surface of the panel. Also, an electron gun is mounted within the neck, the electron gun emitting electron beams toward the phosphor screen. The funnel is positioned between the panel and the neck, and has a deflection yoke mounted to an outer circumference thereof for deflecting the electron beams emitted from the electron gun.

A configuration in which a scanning velocity modulation (SVM) coil is mounted on the neck of the CRT is well known. The SVM coil synchronizes a position of the electron beams passing through each electrode of the electron gun with image signals applied to the CRT to improve the resolution around edges of the image realized on the phosphor screen. The SVM coil is generally comprised of two saddle-shaped coils that are mounted in series and opposing each other on the neck of the CRT. Signals obtained by taking the second derivative of brightness signals of the image signals are applied to the SVM coil.

A CRT utilizing an SVM coil will now be described with reference to FIG. 7, which is an enlarged, partial sectional view of a neck of a conventional projection-type CRT.

An electron gun 10 that emits an electron beam is mounted in a neck 116. The electron gun 10 emits the electron beam in a rightward direction (in the drawing). The electron gun 10 includes a cathode 110 that emits the electron beam; a plurality of grid electrodes G1, G2, G3, G4, and G5 (hereinafter referred to as first, second, third, fourth, and fifth grid electrodes, respectively) that converge and accelerate the electron beams emitted from the cathode 110; and a bead glass 112 that fixes the first, second, third, fourth, and fifth grid electrodes G1, G2, G3, G4, and G5 in an aligned arrangement.

The first and second grid electrodes G1 and G2 have a short length in an axial direction Z of the CRT, while the third and fourth grid electrodes G3 and G4 are cylindrical and have a long length in the axial direction Z relative to the first and second grid electrodes G1 and G2. The fourth grid electrode G4 acts as a focusing electrode that converges the electron beams.

An SVM coil 114 is mounted to an outer circumference of the neck 116 at a position corresponding to the location of the third and fourth grid electrodes G3 and G4. That is, the SVM coil 114 is mounted to the neck 116 overlapping an area corresponding to the location between the third and fourth grid electrodes G3 and G4, and extending a predetermined distance in both directions.

In the CRT structured as in the above, the SVM coil 114 generates a magnetic field to control the landing of the electron beams on desired locations of a phosphor screen (not shown), that is, to control the scanning of the electron beams. However, the electron gun 10 reduces the ability of the electron beams to be scanned. In more detail, good results with respect to the magnetic field (generated by the SVM coil 114) controlling the electron beams are obtained only when all obstructions are removed as much as possible to allow the full effect of the magnetic field. However, because of the way in which the fourth grid electrode G4 is structured, the magnetic field is not able to directly act on the electron beams and is partially blocked reducing the strength of the magnetic field. Therefore, the landing of the electron beams cannot be precisely controlled. Further, when the magnetic field is partially blocked by the fourth grid electrode G4, an eddy current is generated on a surface of the fourth grid electrode G4 such that the magnetic field acting on the electron beams is further weakened. Here, the eddy current is proportional to a surface area of the electrode that blocks the magnetic field.

Although it is possible to improve a sensitivity of the magnetic field by varying a position of the SVM coil 114 on the neck 116, it is difficult to change the position of the SVM coil 114 since its mounting position is determined when designing the electron gun 10. Accordingly, in order to increase the sensitivity of the magnetic field, a number of windings of the SVM coil 114 or an amount of current flowing therethrough must be increased to strengthen the magnetic field. However, increasing the number of windings makes the SVM coil 114 larger and increasing the current increases the amount of power consumed by the SVM coil 114.

In an attempt to remedy these problems, Japanese Laid-open Patent No. Showa 55-146847 discloses a CRT in which an electron gun corresponding to a position of an SVM coil is realized through at least two separated electrodes with a predetermined gap between the electrodes. The SVM coil is mounted to an outer circumference of a neck corresponding to a position of the gap such that a magnetic field generated by the SVM coil passes through the gap.

Although sensitivity of the magnetic field can be enhanced in direct proportion to gap size, increases in gap size weaken the ability of the separated electrodes to converge electron beams as a result of an electrical field that enters from an exterior of the electrodes (e.g., an electrical field formed by a connector that electrically connects the separated electrodes). Therefore, it is not possible to make the gap large enough to realize sufficient improvements in magnetic field sensitivity of the SVM coil. That is, there are limits to how much the sensitivity of the magnetic field of the SVM coil can be increased.

Japanese Laid-open Patent No. Heisei 8-115684 discloses an electron gun in which electrodes of the electron gun corresponding to where an SVM coil is mounted are separated to form a gap, and a shield electrode is mounted to an end of the electrodes. By the operation of the shield electrode, a focus deterioration caused by the entrance of an external electrical field into the gap is prevented, and a reduction in the amount of an eddy current generated is realized such that a sensitivity of the magnetic field of the SVM coil is improved. However, this configuration has limitations as to how much the magnetic field sensitivity can be improved. That is, the gap cannot be made sufficiently large to markedly improve the magnetic field sensitivity of the SVM coil.

Japanese Laid-open Patent No. Heisei 11-162372 discloses an electron gun, in which slits are formed on side surfaces of electrodes of the electron gun that correspond to a position of an SVM coil. The slits are formed perpendicular to a direction electron beams travel. An electric field generated by the SVM coil passes through the slits such that the entrance of an external electric field into a gap and the generation of eddy currents on surfaces of the electrodes are prevented. However, the formation of the slits on side surfaces of the electrodes is more difficult than can be justified by the advantages obtained. Such difficulties result in increasing overall manufacturing costs.

SUMMARY OF THE INVENTION

The present invention has been made in an effort to solve the above problems.

It is an object of the present invention to provide an electron gun for a cathode ray tube and a cathode ray tube using the electron gun, in which a magnetic field generated by an SVM coil is made more effective and the deterioration of focus caused by an external electrical field is prevented.

To achieve the above object, the present invention provides an electron gun for a cathode ray tube and a cathode ray tube using the electron gun. The electron gun includes a cathode for emitting an electron beam; a plurality of grid electrodes aligned sequentially from the cathode, one of the grid electrodes including a plurality of focusing electrodes that are mounted with a predetermined gap therebetween; a support for fixing the grid electrodes in their aligned arrangement; and a shield electrode mounted covering the gap(s) of the focusing electrodes and extending a predetermined distance over the focusing electrodes.

According to a feature of the present invention, a plurality of openings are formed at predetermined distances in the shield electrode, and the shield electrode is cylindrical and is mounted on the focusing electrodes covering the gap(s).

According to another feature of the present invention, the shield electrode is a single unit.

According to yet another feature of the present invention, the shield electrode is formed of a plurality of separate elements.

According to still yet another feature of the present invention, if the gap between the focusing electrodes is denoted by g1, the gap satisfies the following condition:

$$4\ \text{mm} < g1 < 12\ \text{mm}$$

According to still yet another feature of the present invention, the plurality of focusing electrodes are realized through first and second separated focusing electrodes that satisfy the following condition:

$$b\ \text{mm} > 0.5a\ \text{mm}$$

where (a) is an inner diameter of the first separated focusing electrode and (b) is a length of the first separated focusing electrode in an axial direction of the CRT.

According to still yet another feature of the present invention, the shield electrode satisfies the following condition:

$$0.25d\ \text{mm}^2 < c\ \text{mm}^2 < 0.75d\ \text{mm}^2$$

where (c) is a total area of the openings and (d) is an area of the shield electrode minus the area occupied by the openings.

According to still yet another feature of the present invention, a thickness (t) of the shield electrode satisfies the following condition:

$$0.06\ \text{mm} < t < 0.4\ \text{mm}$$

According to still yet another feature of the present invention, distances g2 between centers of the openings satisfy the following condition:

$$0.3\ \text{mm} < g2 < 0.75\ \text{mm}$$

According to still yet another feature of the present invention, a distance between openings formed in the shield electrode corresponding to where the shield electrode covers the first separated focusing electrode is smaller than a distance between openings formed in the shield electrode corresponding to where the shield electrode covers the second separated focusing electrode.

According to still yet another feature of the present invention, the shield electrode is made of a non-magnetic material.

According to still yet another feature of the present invention, the openings are circular.

According to still yet another feature of the present invention, the openings are multilateral.

According to still yet another feature of the present invention, the shield electrode directly contacts the focusing electrodes by welding.

According to still yet another feature of the present invention, the shield electrode is provided at a predetermined distance from the focusing electrodes by being fixedly mounted to the support through protrusions integrally formed to the shield electrode.

According to still yet another feature of the present invention, the shield electrode is fixedly mounted to the support through protrusions integrally formed to the shield electrode.

According to still yet another feature of the present invention, the cathode emits a single electron beam.

The cathode ray tube includes the electron gun; a neck, within which the electron gun is mounted; and a scanning velocity modulation coil mounted on an outer circumference of the neck corresponding to the positioning of the gap(s) of the focusing electrodes.

According to a feature of the present invention, the cathode ray tube is a projection-type cathode ray tube, in which a single electron beam is emitted from the cathode.

BRIEF DESCRIPTION OF THE DRAWINGS

The accompanying drawings, which are incorporated in and constitute a part of the specification, illustrate an exemplary embodiment of the invention, and, together with the description, serve to explain the principles of the invention.

DETAILED DESCRIPTION OF THE PREFERRED EMBODIMENTS

Exemplary preferred embodiments of the present invention will now be described in detail with reference to the accompanying drawings.

Figure 1:
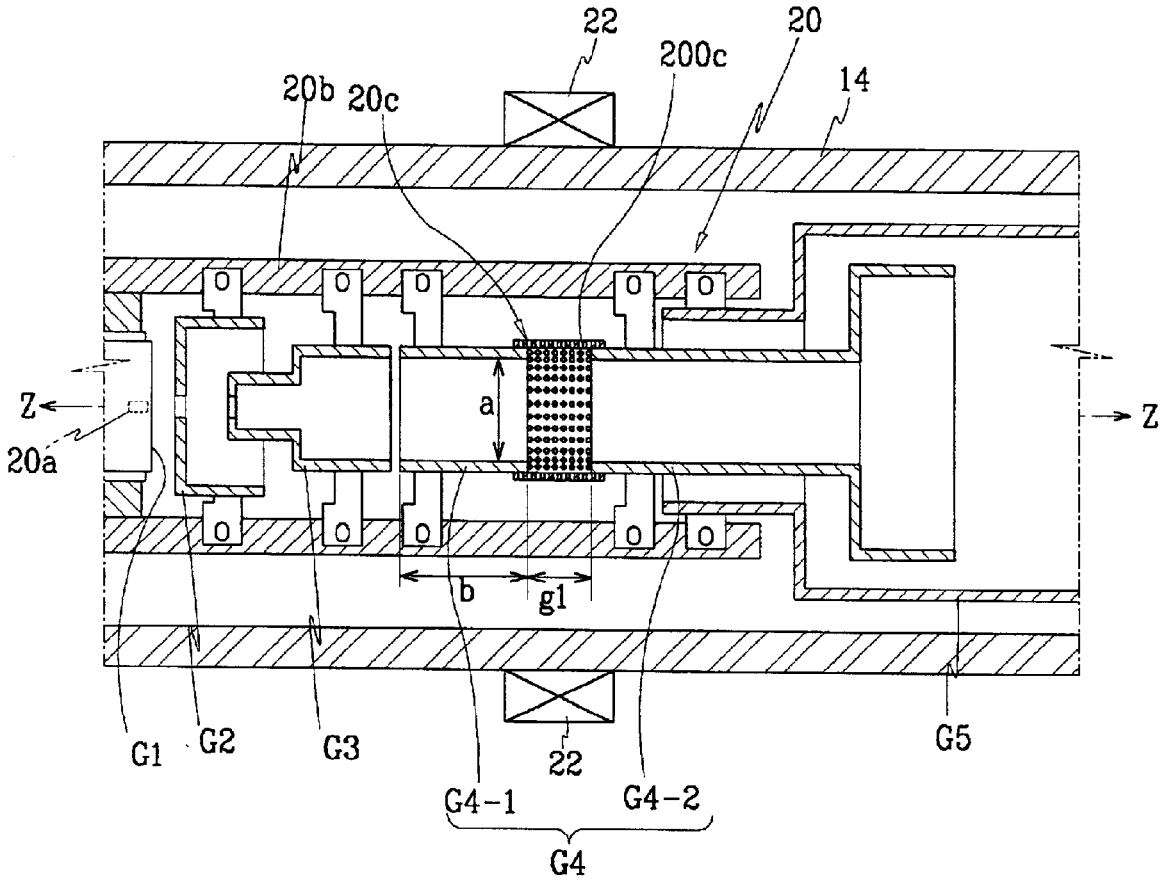
FIG. 1 is an enlarged, partial sectional view of a neck of a cathode ray tube according to a first preferred exemplary embodiment of the present invention.

FIG. 1 is an enlarged, partial sectional view of a neck of a cathode ray tube according to a preferred exemplary embodiment of the present invention.

An electron gun 20 that emits electron beams is mounted within a neck 14 of a cathode ray tube (CRT). The electron beams generated by the electron gun 20 are emitted onto a phosphor screen (not shown) formed on a panel (not shown) to realize desired images. In the preferred embodiment of the present invention, a projection-type CRT, in which the electron gun 20 emits a single electron beam, is used as an example.

The electron gun 20 includes a cathode 20*a* for emitting the single electron beam; first, second, third, fourth, and fifth grid electrodes G1, G2, G3, G4, and G5 for controlling the electron beam emitted from the cathode 20*a*; and a support 20*b* for fixing the first, second, third, fourth, and fifth grid electrodes G1, G2, G3, G4, and G5 in an aligned arrangement. In an exemplary embodiment, the fourth grid electrode G4 (i.e., focusing electrode) is divided into a plurality of electrodes provided with a predetermined gap g1 therebetweeen. In a preferred exemplary embodiment of the present invention, the fourth grid electrode G4 is divided into a first separated focusing electrode G4-1 and a second separated focusing electrode G4-2 with the gap g1 formed therebetween.

A drive voltage lower than that applied to the cathode 20*a* is applied to the first grid electrode G1, and a drive voltage higher than that applied to the cathode 20*a* is applied to the second grid electrode G2. A drive voltage of approximately 32 kV is applied to the third and fifth grid electrodes G3 and G5, and a drive voltage of 10–20 kV is applied to the fourth grid electrode G4 (i.e., to each of the electrodes comprising the fourth grid electrode G4).

An SVM coil 22 is mounted to an outer circumference of the neck 14. As shown in the drawing, the SVM coil 22 is mounted to an area of the neck 14 corresponding to the position of the gap g1. The SVM coil 22 generates a magnetic field to control the scanning of the electron beam generated by the electron gun 20 on the phosphor screen of the panel.

A configuration for the CRT to realize an improvement in the sensitivity of the magnetic field generated by the SVM coil 22, and to prevent the entrance of an external electrical field into the gap g1 according to the preferred exemplary embodiment of the present invention will now be described.

The fourth electrode G4, which acts as a focusing electrode, includes the first and second separated focusing electrodes G4-1 and G4-2 with the gap g1 formed therebetween as described above. The magnetic field generated by the SVM coil 22 passes through the gap g1. A shield electrode 20*c* is mounted over the gap g1 and extends a predetermined distance in both directions to partially overlap the first and second separated focusing electrodes G4-1 and G4-2. The shield electrode 20*c* prevents an external electrical field from entering into the gap g1.

Figure 2:
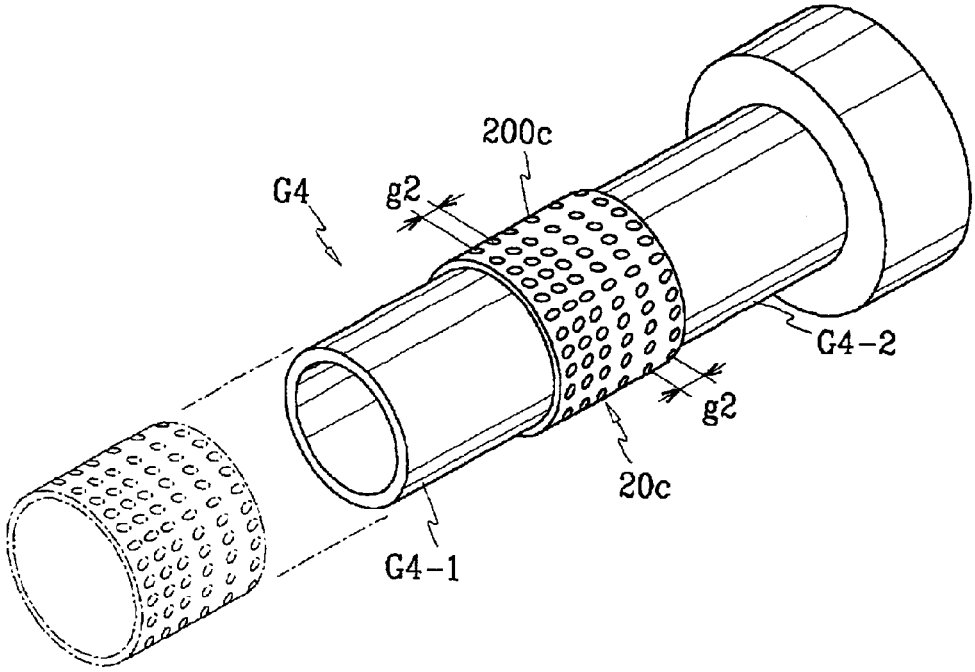
FIG. 2 is a perspective view showing a connection state between focusing electrodes of an electron gun and a shield electrode according to the first preferred exemplary embodiment of the present invention.

In the first preferred embodiment of the present invention, the shield electrode 20*c*, with reference to FIG. 2, is cylindrical and includes a plurality of openings 200*c* formed therethrough. As described above, the shield electrode 20*c* is mounted covering the gap g1 and extends a predetermined distance in both directions to partially overlap the first and second separated focusing electrodes G4-1 and G4-2. The shield electrode 20*c* according to the first preferred exemplary embodiment is a single unit as shown in FIG. 2. However, the shield electrode 20*c* according to a second preferred exemplary embodiment of the present invention, with reference to FIG. 3, is formed from a plurality of separate elements (two in the second preferred exemplary embodiment).

Figure 3:
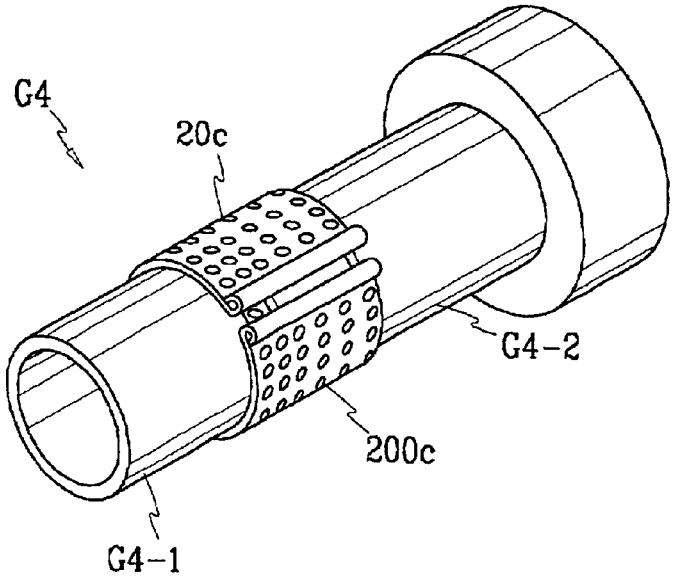
FIG. 3 is a perspective view showing a connection state between focusing electrodes of an electron gun and a shield electrode according to a second preferred exemplary embodiment of the present invention.
Figure 4:
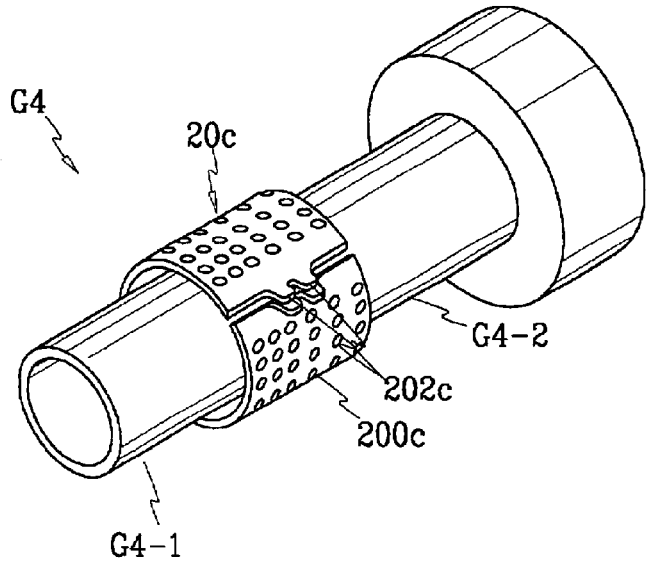
FIG. 4 is a perspective view showing a connection state between focusing electrodes of an electron gun and a shield electrode according to a third preferred exemplary embodiment of the present invention.
Figure 5:
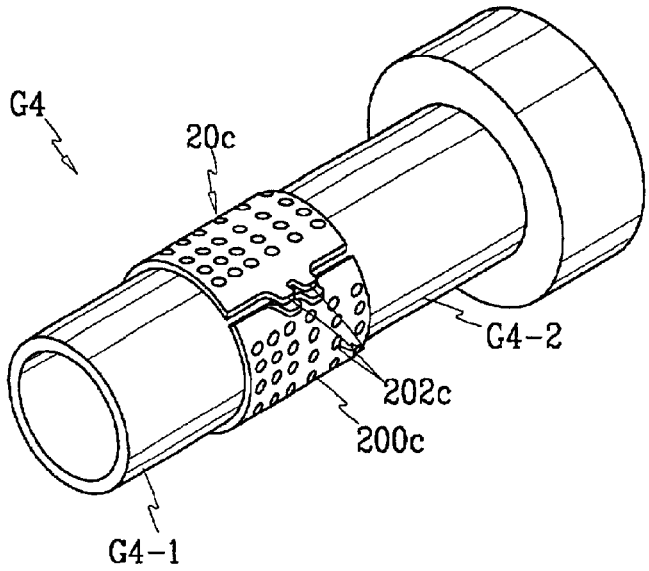
FIG. 5 is a perspective view showing a connection state between focusing electrodes of an electron gun and a shield electrode according to a fourth preferred exemplary embodiment of the present invention.

With reference to FIGS. 2 and 3 (first and second preferred exemplary embodiments), the shield electrode 20*c* is connected to the fourth grid electrode G4 by placing the shield electrode 20*c* at a desired location covering the gap g1 and directly contacting the first and second separated focusing electrodes G4-1 and G4-2, then by welding the shield electrode 20*c* to the first and second separated focusing electrodes G4-1 and G4-2. Alternatively, with reference to FIG. 4 (third preferred exemplary embodiment), the shield electrode 20*c* realizes its connection by placing the shield electrode 20*c* at a desired location covering the gap g1 but maintaining a predetermined distance from the first and second separated focusing electrodes G4-1 and G4-2, then by connecting protrusions 202*c* integrally formed on the shield electrode 20*c* to the support 20*b* (shown in FIG. 1) such that the shield electrode 20*c* is suspended in the desired location. It is also possible to connect the shield electrode 20*c* as described with reference to FIG. 4 but in a state directly contacting the first and second separated focusing electrodes G4-1 and G-42. This last configuration is shown in FIG. 5 (fourth preferred exemplary embodiment).

The shield electrode 20*c* is electrically connected to the first and second separated focusing electrodes G4-1 and G4-2 through the direct contact between these elements as in the first, second, and fourth preferred exemplary embodiments of the present invention. In the case where the shield electrode 20*c* is mounted at a predetermined distance from the first and second separated focusing electrodes G4-1 and G4-2 as in the third preferred exemplary embodiment of the present invention, a conductor (not shown) may be used to electrically connect the shield electrode 20*c* to the first and second separated focusing electrodes G4-1 and G4-2.

In order for the magnetic field generated by the SVM coil 22 to act on the electron beam generated by the electron gun 20 such that the sensitivity of the magnetic field of the SVM coil 22 is improved, the following conditions must be satisfied.

First, the gap g1 between the first and second separated focusing electrodes G4-1 and G4-2 must, in the exemplary embodiment, satisfy the following condition:

$$4\ \text{mm} < g1 < 12\ \text{mm}$$

Further, to effect a favorable lens operation between the third grid electrode G3 and the first separated focusing electrode G4-1, the following condition must be satisfied:

$$b\ \text{mm} > 0.5a\ \text{mm}$$

where (b) is a length of the first separated focusing electrode G4-1 in the axial direction Z of the CRT, and (a) is an inner diameter of the first separated focusing electrode G4-1.

Also, to prevent the formation of eddy currents by the magnetic field generated by the SVM coil, the following condition must be satisfied:

$$0.25d\ mm^2 < c\ mm^2 < 0.75d\ mm^2$$

where (c) is a total area of the openings 200*c*, and (d) is an area of the shield electrode 20*c* minus the area occupied by the openings 200*c*.

A thickness (t) of the shield electrode 20*c* must satisfy the condition as follows:

$$0.06\ mm < t < 0.4\ mm$$

Finally, distances g2 between centers of the openings must satisfy the following condition to effectively prevent an external electrical field from passing into the gap g1 of the fourth grid electrode G4.

$$0.3\ mm < g2 < 0.75\ mm$$

It is preferable that the distances g2 on portions of the shield electrode 20*c* covering the first separated focusing electrode G4-1 are smaller than the distances g2 on portions of the shield electrode 20*c* covering the second separated focusing electrode G4-2.

In operation of the CRT structured as in the above, the magnetic field generated by the SVM coil 22 passes through the openings 200*c* of the shield electrode 20*c* and into the gap g1 between the first and second separated focusing electrodes G4-1 and G4-2 such that the electron beam passing through the gap g1 receives the force of the magnetic field. During this process, although eddy currents may be formed on the shield electrode 20*c* as a result of the magnetic field striking the shield electrode 20*c*, this problem is substantially eliminated since the surface area of the shield electrode 20*c* is reduced by the formation of the openings 200*c*.

Further, in the case where the shield electrode 20*c* is electrically connected to the first and second separated focusing electrodes G4-1 and G4-2 without the use of a separate device (i.e., as in the first, second, and fourth preferred embodiments), the electron beam passing through the first and second separated focusing electrodes G4-1 and G4-2 is not affected by an external electrical field entering from an exterior of the first and second separated focusing electrodes G4-1 and G4-2.

As a result, the sensitivity of the magnetic field generated by the SVM coil 16 and focusing characteristics of the electron beam are significantly improved such that a high-resolution image with enhanced clarity is realized.

Figure 6A:
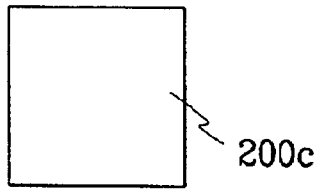
FIGS. 6*a*, 6*b*, and 6*c* show different configurations of an opening of a shield electrode according to a preferred exemplary embodiment of the present invention.
Figure 6B:
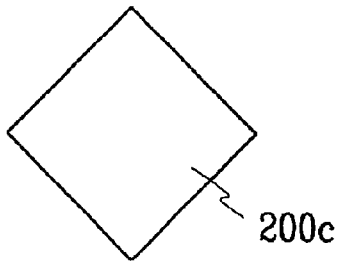
Figure 6C:
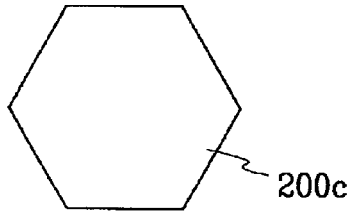
Figure 7:
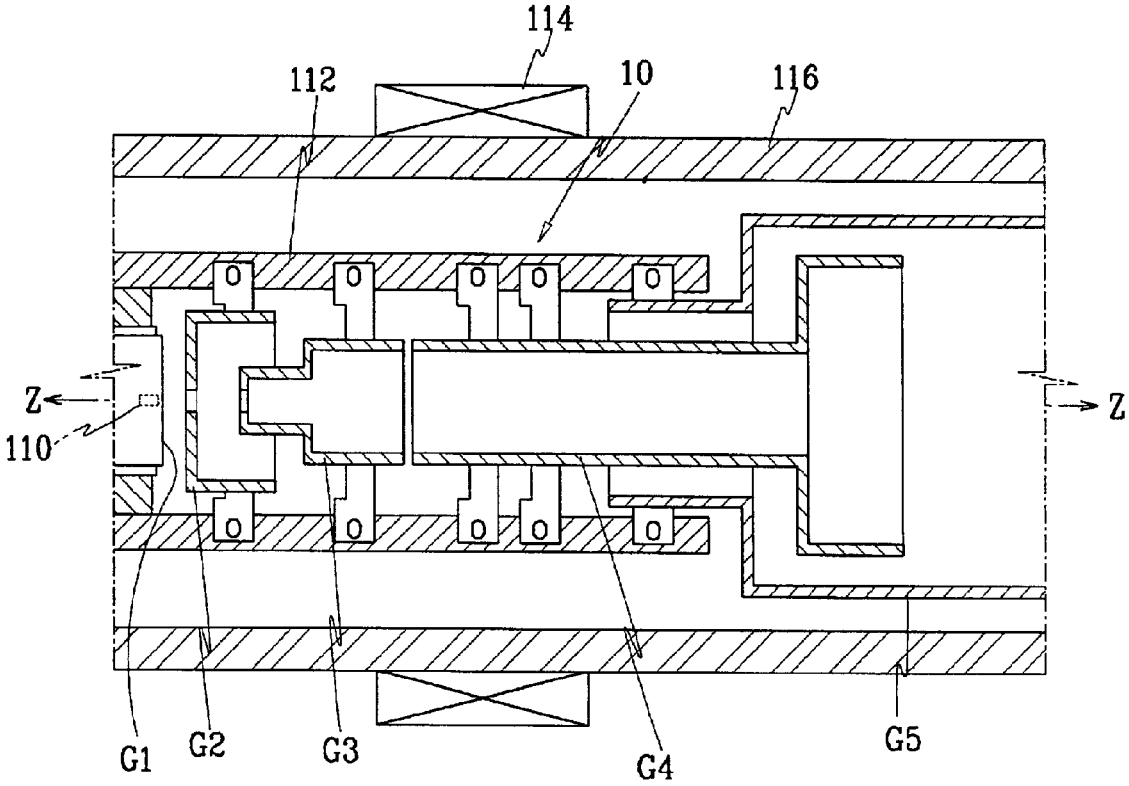
FIG.7(Prior Art)
FIG. 7 is an enlarged, partial sectional view of a neck of a conventional projection type CRT.

In the preferred embodiments of the present invention, the openings 200*c* are shown as being circular. However, the present invention is not limited to this configuration and it is possible for the openings 200*c* to be quadrilateral or take on other various multilateral shapes as for example shown in FIGS. 6*a*, 6*b*, and 6*c*.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims. For example, one of the grid electrodes, as for example the fourth grid electrode G4, may be divided into first, second and third focusing electrodes where each focusing electrode is separated from the other by a gap and each gap is surrounded by the shield electrode as disclosed herein.

What is claimed is:

1. An electron gun for a cathode ray tube comprising:

a cathode for emitting an electron beam;

a plurality of grid electrodes aligned sequentially from the cathode, one of the grid electrodes including a plurality of focusing electrodes that are mounted with at least one predetermined gap therebetween;

a support for fixing the grid electrodes in their aligned arrangement; and a shield electrode mounted covering the at least one gap of the focusing electrodes and extending a predetermined distance over the focusing electrodes, wherein a plurality of openings are formed at predetermined distances through the shield electrode, and the shield electrode is cylindrical and is mounted on the focusing electrodes covering the at least one gap and wherein the shield electrode satisfies the following condition:

$$0.25d\ mm^2 < c\ mm^2 < 0.75d\ mm^2$$

where (c) is a total area of the openings and (d) is an area of the shield electrode minus the area occupied by the openings.

2. An electron gun for a cathode ray tube comprising:

a cathode for emitting an electron beam;

a plurality of grid electrodes aligned sequentially from the cathode, one of the grid electrodes including a plurality of focusing electrodes that are mounted with at least one predetermined gap therebetween;

a support for fixing the grid electrodes in their aligned arrangement; and a shield electrode mounted covering the at least one gap of the focusing electrodes and extending a predetermined distance over the focusing electrodes, wherein a plurality of openings are formed at predetermined distances through the shield electrode, and the shield electrode is cylindrical and is mounted on the focusing electrodes covering the at least one gap and wherein a thickness (t) of the shield electrode satisfies the following condition:

$$0.06\ mm < t < 0.4\ mm.$$

3. The electron gun of claims 1 or 2 wherein distances g2 between centers of the openings satisfy the following condition:

$$0.3\ mm < g2 < 0.75\ mm.$$

4. An electron gun for a cathode ray tube comprising:

a cathode for emitting an electron beam;

a plurality of grid electrodes aligned sequentially from the cathode, one of the grid electrodes including a plurality of focusing electrodes that are mounted with at least one predetermined gap therebetween;

a support for fixing the grid electrodes in their aligned arrangement; and a shield electrode mounted covering the at least one gap of the focusing electrodes and extending a predetermined distance over the focusing electrodes, wherein the plurality of focusing electrodes comprise first and second separated focusing electrodes that satisfy the following condition:

$$b\ mm > 0.5a\ mm$$

where (a) is an inner diameter of the first separated focusing electrode and (b) is a length of the first separated focusing electrode in an axial direction of the CRT and wherein a distance between openings formed in the shield electrode corresponding to where the shield electrode covers the first separated focusing electrode is smaller than a distance between openings formed in the shield electrode corresponding to where the shield electrode covers the second separated focusing electrode.

5. The electron gun of claims 1, 2, or 4 wherein the shield electrode is made of a non-magnetic material.

6. The electron gun of claims 1, 2, or 4 wherein the openings are circular.

7. The electron gun of claims 1, 2, or 4 wherein the openings are multilateral.

8. The electron gun of claims 1, 2, or 4 wherein the shield electrode directly contacts the focusing electrodes.

9. The electron gun of claims 1, 2, or 4 wherein the cathode emits a single electron beam.

* * * * *